US010267202B2

(12) United States Patent
Magner et al.

(10) Patent No.: US 10,267,202 B2
(45) Date of Patent: Apr. 23, 2019

(54) METHOD AND SYSTEM FOR CATALYST FEEDBACK CONTROL

(71) Applicant: Ford Global Technologies, LLC, Dearborn, MI (US)

(72) Inventors: Stephen William Magner, Farmington Hills, MI (US); Mrdjan J. Jankovic, Brimingham, MI (US); Mario Anthony Santillo, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 102 days.

(21) Appl. No.: 15/285,371

(22) Filed: Oct. 4, 2016

(65) Prior Publication Data

US 2018/0094563 A1 Apr. 5, 2018

(51) Int. Cl.

| | |
|---|---|
| ***F01N 9/00*** | (2006.01) |
| ***F01N 3/20*** | (2006.01) |
| ***F01N 3/10*** | (2006.01) |
| ***F02D 41/14*** | (2006.01) |
| ***F01N 13/00*** | (2010.01) |
| *F02D 41/18* | (2006.01) |

(52) U.S. Cl.

CPC ..... *F01N 9/00* (2013.01); *F01N 3/10* (2013.01); *F01N 3/20* (2013.01); *F01N 13/009* (2014.06); *F02D 41/1401* (2013.01); *F02D 41/1438* (2013.01); *F02D 41/1441* (2013.01); *F01N 2430/06* (2013.01); *F01N 2560/02* (2013.01); *F01N 2560/025* (2013.01); *F01N 2900/0402* (2013.01); *F01N 2900/0412* (2013.01); *F01N 2900/08* (2013.01); *F01N 2900/1402* (2013.01); *F01N 2900/1602* (2013.01); *F02D 41/18* (2013.01); *F02D 2041/1409* (2013.01); *F02D 2041/1419* (2013.01); *F02D 2041/1422* (2013.01); *F02D 2041/1423* (2013.01); *F02D 2200/0406* (2013.01)

(58) Field of Classification Search

CPC ..... F01N 2900/0402; F01N 2900/0408; F01N 2900/0412; F02D 2041/1409; F02D 2041/1419; F02D 2041/1423; F02D 2041/1426

See application file for complete search history.

(56) References Cited

U.S. PATENT DOCUMENTS

| | | | | |
|---|---|---|---|---|
| 6,879,906 | B2 | 4/2005 | Makki et al. | |
| 7,987,840 | B2 | 8/2011 | Magner et al. | |
| 8,255,066 | B2 | 8/2012 | Boiko et al. | |
| 8,800,356 | B2 | 8/2014 | Makki et al. | |
| 2004/0050034 | A1* | 3/2004 | Yasui | F02D 41/1403 60/276 |
| 2004/0244363 | A1 | 12/2004 | Makki et al. | |
| 2013/0245919 | A1 | 9/2013 | Kumar et al. | |
| 2015/0204258 | A1 | 7/2015 | Kumar et al. | |

* cited by examiner

*Primary Examiner* — Jonathan Matthias

(74) *Attorney, Agent, or Firm* — Julia Voutyras; McCoy Russell LLP

(57) ABSTRACT

Methods and systems are provided for catalyst control. In one example, a method may include controlling an air-fuel ratio downstream of a catalyst by adjusting fuel injection. The fuel injection is adjusted based on control parameters updated online through system identification at a point of feedback control instability.

19 Claims, 7 Drawing Sheets

METHOD AND SYSTEM FOR CATALYST FEEDBACK CONTROL

FIELD

The present description relates generally to methods and systems for controlling an air-fuel ratio downstream of a catalyst in an engine exhaust system.

BACKGROUND/SUMMARY

Emissions from an engine system may be controlled with a catalyst coupled to an engine exhaust system. In order to maintain high catalyst efficiency, air-fuel ratio of the exhaust gas passing through the catalyst needs to be closely regulated. Air-fuel ratio of the exhaust gas may be controlled via controllers by adjusting a fuel injection amount using a mix of feedforward and feedback control loops. Tuning the controllers under various engine operation conditions may be complicated and time consuming. The complexity arises from a lack of understanding of the engine system and difficulty of isolating the underlying cause of the varied system response.

Other attempts to determine control parameters include tuning the controller through relay feedback. One example approach is shown by Boiko et al. in U.S. Pat. No. 8,255,066B2. Therein, oscillations corresponding to a selected gain or phase margin are generated, and PID controller tuning parameters are computed based on the amplitude and frequency of the oscillations.

However, the inventors herein have recognized that an identification that is specifically aimed at the appropriate model, in this case an automotive exhaust after-treatment system, versus a generic controller adjustment, provides more insight and coverage of varied operating conditions. A simple model that is just adequate to capture the dynamic response of the system in the frequency range of interest may resolve the controller tuning issue. The model may be easily characterized and can be incorporated into the controller structure. Further, control response may benefit from an update on-line to the original (in factory) calibration of control parameters to address control parameter drift due to catalyst degradation over time.

In one example, the issues described above may be addressed by a method including during steady state engine operation, adjusting fuel injection to a cylinder responsive to sensor feedback from downstream of a catalyst volume based on control parameters, the control parameters determined based on system identification at a point of feedback control instability. In this way, during engine operation, control parameters may be updated online with minor impact on engine/catalyst operation. Further, the updated control parameters may better account for system degradation and preserve high catalyst efficiency.

As one example, air-fuel ratio upstream of a catalyst may be controlled via an inner feedback loop, and air-fuel ratio downstream of the catalyst may be controlled via an outer feedback loop. Control parameters of the outer feedback loop may be tuned off-line at each of a set of pre-determined mass flow rates upstream of the catalyst. The calibrated control parameters may be saved in an engine controller and used during engine operation responsive to engine operating conditions. The lookup table may be updated online during steady state engine operation. Specifically, an oscillation in air-fuel ratio downstream of the catalyst may be induced by controlling the inner feedback loop via a relay function. As such, the outer feedback control loop reaches feedback control instability, and control parameters may be updated based on system identification. In this way, control parameters may be updated online based on a minimalist dynamic characterization of the catalyst control loop with minor impact on engine/catalyst operation. The updated control parameters enable high catalyst efficiency being achieved under a wide range of engine operating conditions. Further, the lookup table may be generated off-line to provide an initial characterization for all operating conditions under controlled laboratory conditions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
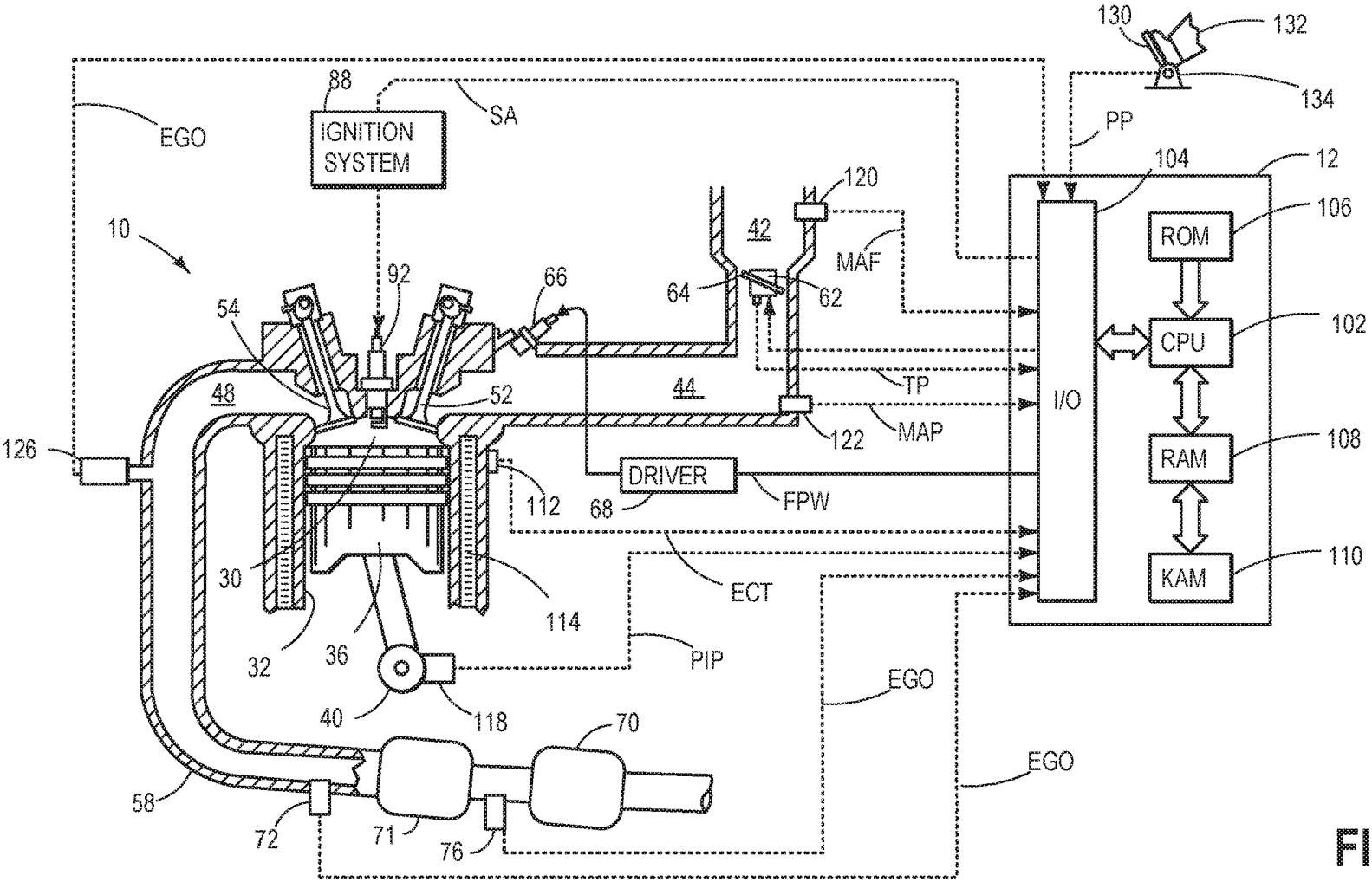
FIG. 1 shows a block diagram of an example engine system.
Figure 2:
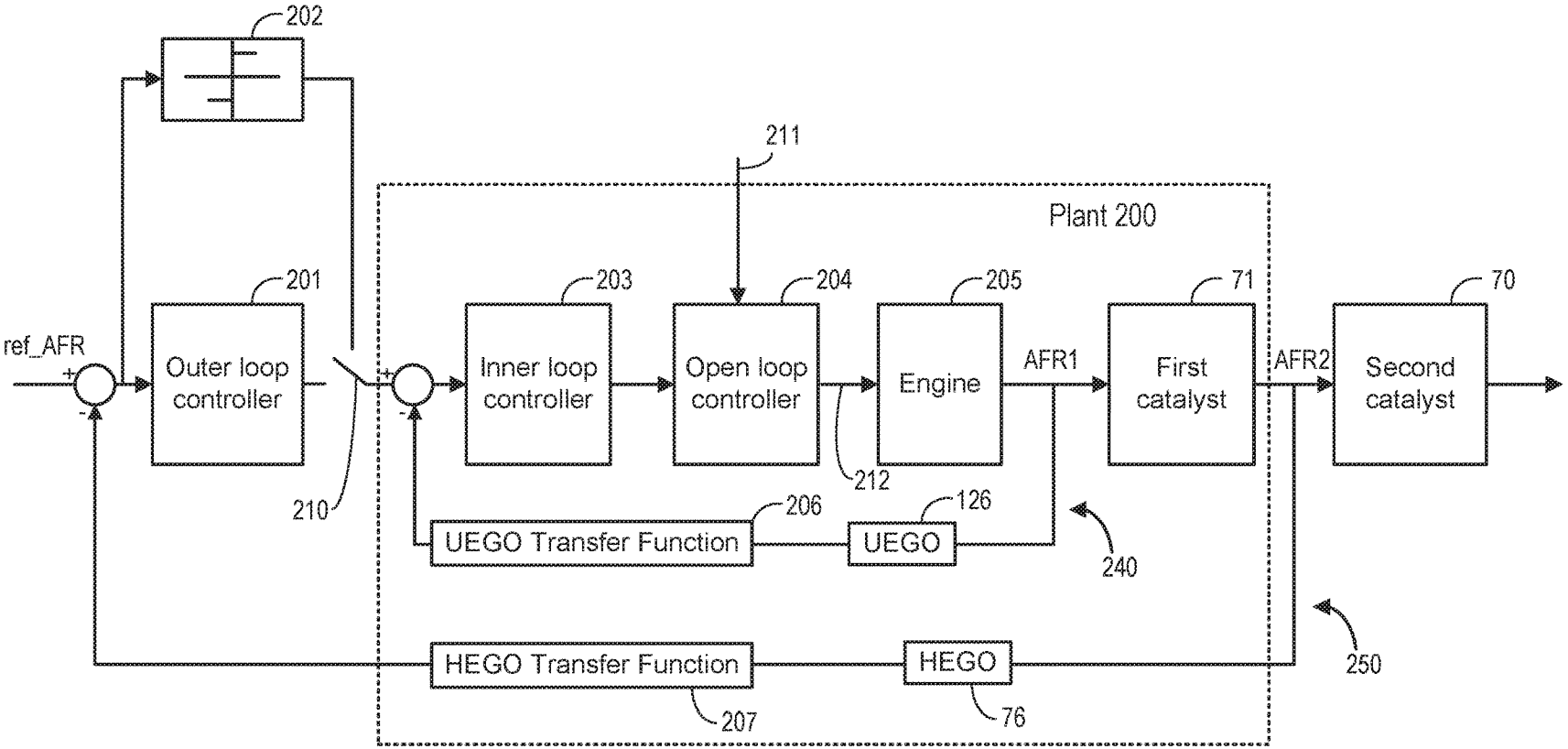
FIG. 2 is a high level block diagram demonstrating catalyst control loops.
Figure 3:
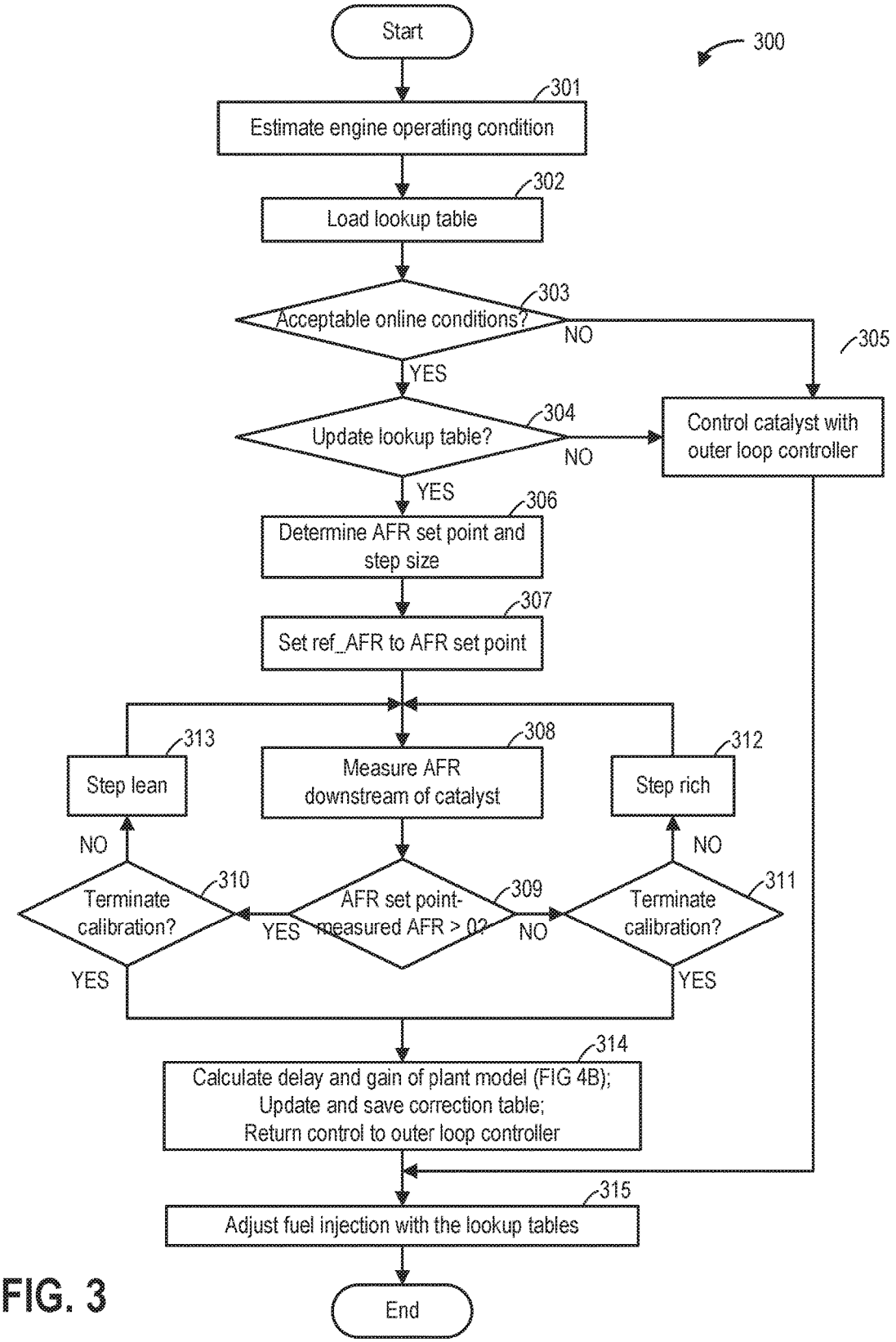
FIG. 3 shows a flow chart demonstrating an example method of catalyst control.
Figure 4A:
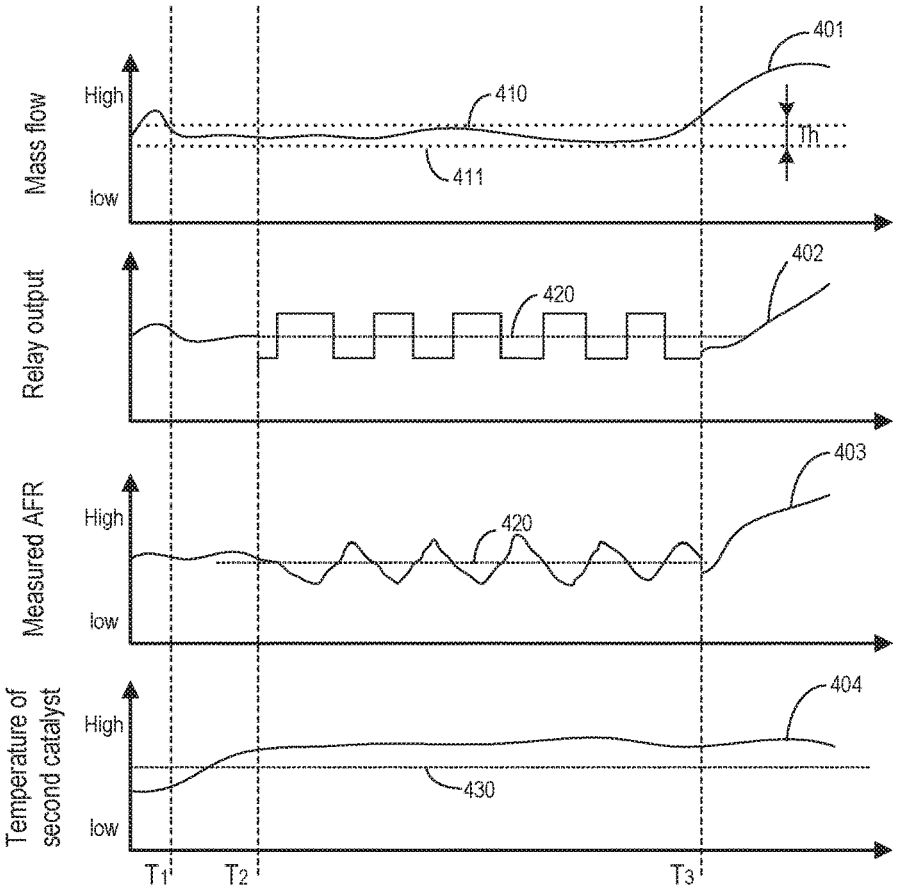
FIG. 4A illustrates timelines of engine operating parameters and signals while implementing the example method.
Figure 4B:
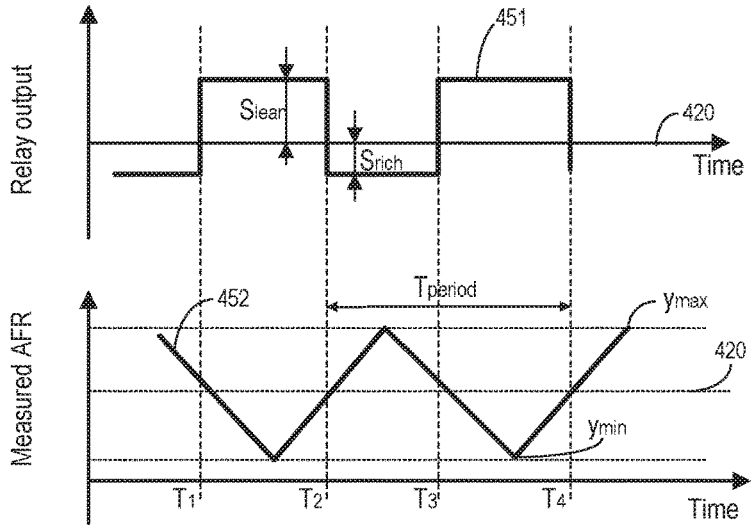
FIG. 4B is a zoomed in view of the timelines shown in FIG. 4A, demonstrating an example method of identifying system parameters based on the system response.
Figure 5:
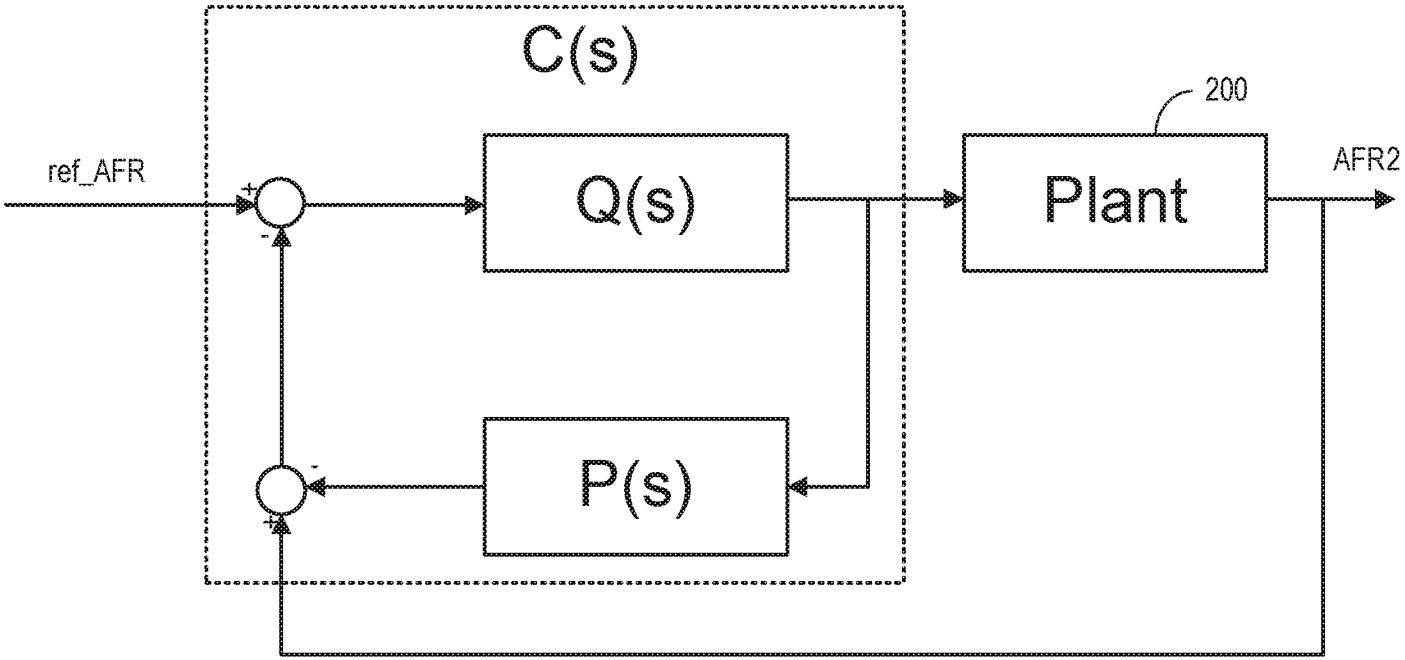
FIG. 5 is an example internal model control structure.
Figure 6:
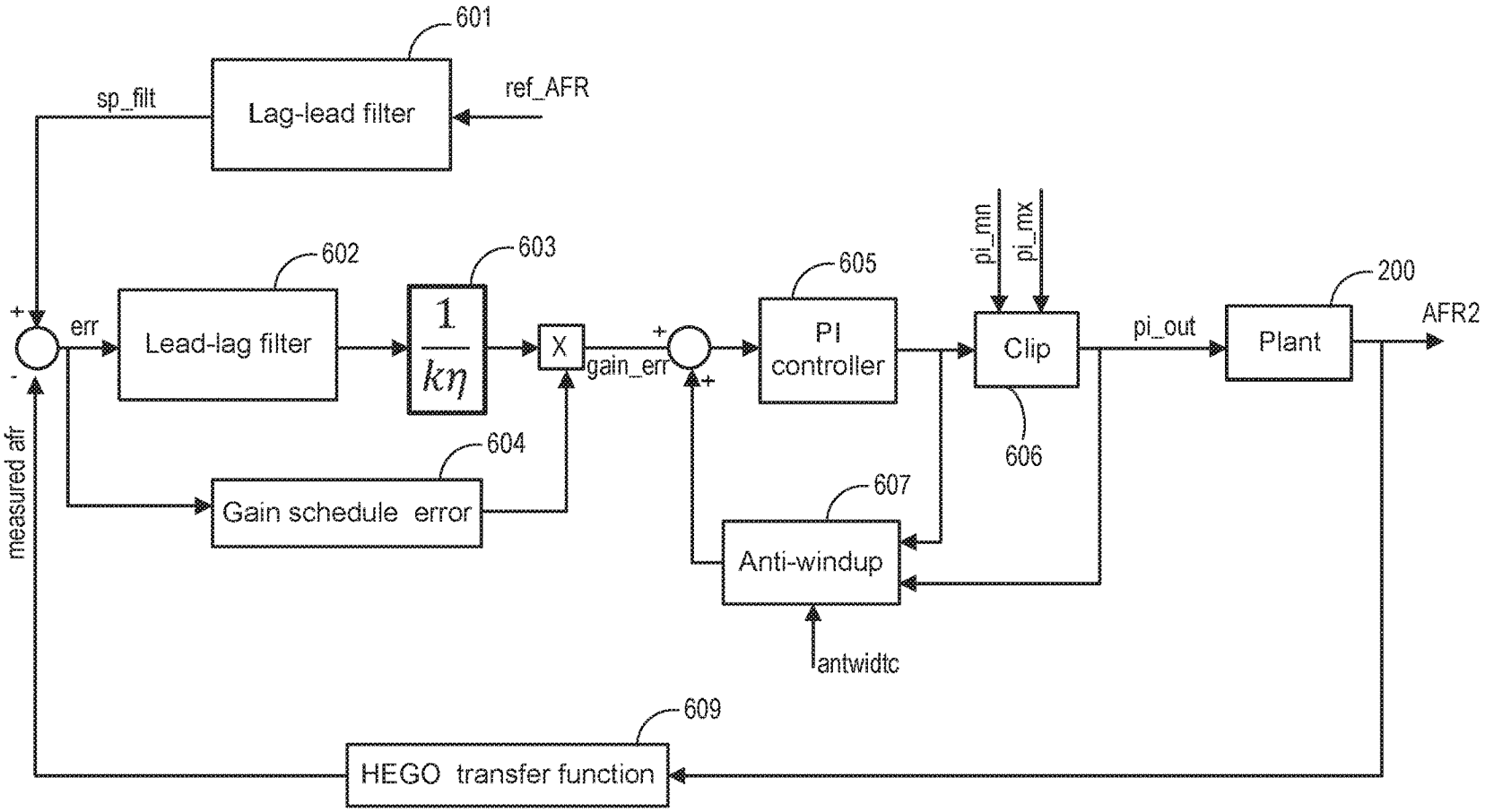
FIG. 6 shows a block diagram of an example outer loop controller for catalyst control.
Figure 7:
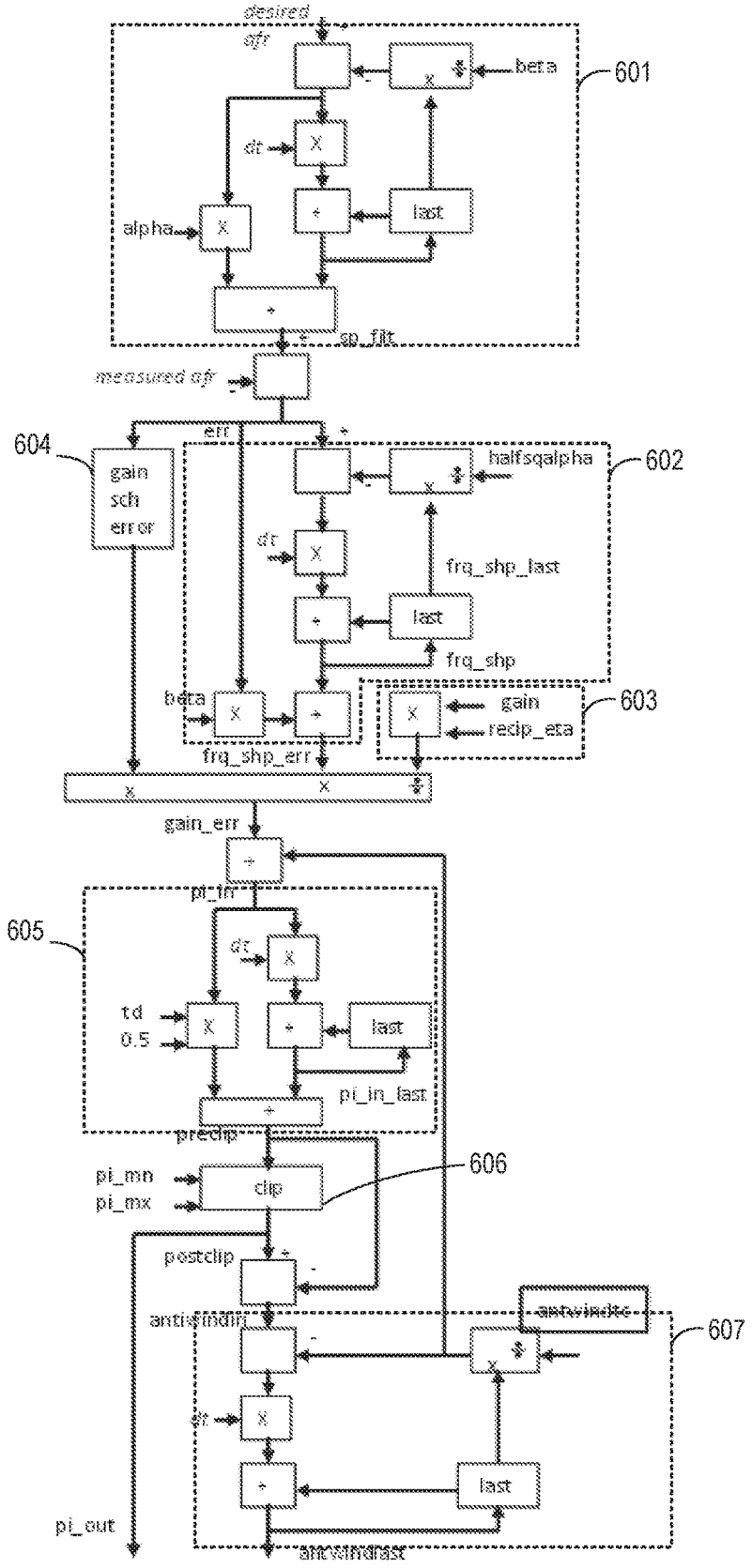
FIG. 7 shows a low level diagram of implementing the example outer loop controller in time domain.

The following description relates to systems and methods for managing operation of an exhaust catalyst by controlling the air-fuel ratio downstream of the catalyst. FIG. 1 shows an example engine system including a catalyst for processing the exhaust gases. FIG. 2 is a high level block diagram demonstrating feedback loops for catalyst control. The feedback control loops includes an outer feedback loop based on feedback of air-fuel ratio downstream of the catalyst, and an inner feedback loop based on feedback of air-fuel ratio upstream of the catalyst. The outer loop controller may be replaced with a relay function to drive the outer feedback loop to a point of feedback control instability. Due to catalyst degradation, the control parameters may benefit from an update. FIG. 3 demonstrates an example method for catalyst control, wherein the control parameters may be updated online at the point of feedback control instability. FIG. 4A illustrates variation of engine operating parameters and the signals over time while implementing the example method shown in FIG. 3. FIG. 4B demonstrates how system delay and system gain may be identified based on the system response. Based on the system delay and system gain, control parameters may be derived via internal model control. An example internal model control structure is shown in FIG. 5. FIG. 6 shows an example block diagram of an example outer loop controller. FIG. 7 is a low level time domain implementation of the outer loop controller shown in FIG. 6.

Turning to FIG. 1, a schematic diagram of one cylinder of multi-cylinder engine 10, which may be included in a propulsion system of a vehicle, is shown. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber 30 (also termed, cylinder 30) of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Combustion chamber 30 may receive intake air from intake manifold 44 via intake passage 42 and may exhaust combustion gases via exhaust manifold 48. Intake manifold 44 and exhaust manifold 48 can selectively communicate with combustion chamber 30 via respective intake valve 52 and exhaust valve 54. In some embodiments, combustion chamber 30 may include two or more intake valves and/or two or more exhaust valves.

Fuel injector 66 is shown arranged in intake manifold 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system (not shown) including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 coupled upstream of throttle 62 for measuring the flow rate of aircharge entering into the cylinder through throttle 62. Intake passage 42 may also include a manifold air pressure sensor 122 coupled downstream of throttle 62 for measuring manifold air pressure MAP.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 58 upstream of emission control device 70. Sensor 126 may be any suitable sensor for providing an indication of exhaust gas air-fuel ratio such as a linear oxygen sensor or UEGO (universal or wide-range exhaust gas oxygen), a narrow band (older systems treat as a two-state device) oxygen sensor or EGO, a HEGO (heated EGO), a NOx, HC, or CO sensor. Emission control devices 71 and 70 are shown arranged along exhaust passage 58 downstream of exhaust gas sensor 126. The first emission control device 71 is upstream of the second emission control device 70. Devices 71 are 70 may be three way catalyst (TWC), NOx trap, various other emission control devices, or combinations thereof. Exhaust gas sensor 76 is shown coupled to exhaust passage 58 downstream of the first emission control device 71. Sensor 76 may be any suitable sensor for providing an indication of exhaust gas air/fuel ratio such as a linear oxygen sensor or UEGO (universal or wide-range exhaust gas oxygen), a narrow band oxygen sensor or EGO, a HEGO (heated EGO), a NOx, HC, or CO sensor. In another embodiment, emission control device 71 and 70 may be combined into one single device with two separate volumes, and a mid-bed sensor may be positioned between the two volumes within the emission control device to detect air-fuel ratio in the middle of the catalyst.

Other sensors 72 such as an air mass flow (AM) and/or a temperature sensor may be disposed upstream of the first emission control device 71 to monitor the AM and temperature of the exhaust gas entering the emission control device. The sensor locations shown in FIG. 1 are just one example of various possible configurations. For example, the emission control system may include one emission control device with a partial volume set-up with close coupled catalysts.

Controller 12 is shown in FIG. 1 as a microcomputer, including microprocessor unit 102, input/output ports 104, an electronic storage medium for executable programs and calibration values shown as read only memory 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; air mass and/or temperature of the exhaust gas entering the catalyst from sensor 72; exhaust gas air-fuel ratio post-catalyst from sensor 76; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses for each revolution of the crankshaft. Additionally, controller 12 may communicate with a cluster display device 136, for example to alert the driver of faults in the engine or exhaust after-treatment system.

Storage medium read-only memory 106 can be programmed with computer readable data representing instructions executable by processor 102 for performing the methods described below as well as other variants that are anticipated but not specifically listed.

The controller 12 receives signals from the various sensors of FIG. 1 and employs the various actuators of FIG. 1 to adjust engine operation based on the received signals and instructions stored on a memory of the controller. For example, adjusting fuel injection may include adjusting pulse width signal FPW to electronic driver 68 to adjust the amount of fuel injected to the cylinder.

FIG. 2 is a high level block diagram demonstrating an outer feedback loop 250 and an inner feedback loop 240 for catalyst control. The inner feedback loop may include inner loop controller 203, open loop controller 204, engine 205, an UEGO sensor 126, and a transfer function 206 that converts sensor voltage to AFR. The outer feedback loop may include outer loop controller 201, a HEGO 76, and a transfer function 207 that converts sensor voltage to AFR, and inner feedback loop. The outer loop controls air-fuel ratio (AFR) downstream of the first catalyst or the first catalyst volume 71 via the outer loop controller 201. The inner loop controls AFR upstream of the first catalyst.

Controller (such as controller 12 in FIG. 1) may send a reference AFR (ref_AFR) signal to the outer feedback loop. The reference AFR may be a desired AFR downstream of the first catalyst. Difference between ref_AFR and measured AFR downstream of the first catalyst AFR2 may be sent as an error signal to outer loop controller 201. By connecting switch 210 with outer loop controller 201, difference between the output from outer loop controller and AFR measured upstream of the first catalyst AFR1 may be calculated and sent to inner loop controller 203. Open loop controller 204 may include a first input receiving output of inner loop controller 203, and a second input 211. As an example, input 211 may be cylinder air charge determined based on torque demand. As another example, input 211 may be inducted air mass. The open loop controller may account for controller (12) compensations including canister purge and cold engine fueling. The open loop compensations give the closed loop system a head start and allow the inner loop controller to only have to trim errors that are not expected. Open loop controller 204, operates in several stages, first accounting for each engine bank control, and then later directing cylinder specific fueling, creating output signal 212 to engine 205, wherein signal 212 may indicate the fuel injection amount. As an example, signal 212 may be a fuel pulse width signal (FPW). In response to signal 212, engine 205 outputs exhaust gases with AFR of AFR1. Exhaust gases may travel through the first catalyst 71 and changed to an AFR of AFR2.

Under certain vehicle operation conditions, such as during steady engine operation and sufficient first (71) and second catalyst (70) activation, switch 210 may be alternatively connect to a relay function 202 for calibrating control parameters of outer loop controller 201. The catalyst may be sufficiently activated if the catalyst temperature is higher than a threshold. The control parameters may be determined based on characteristics of plant 200. Plant 200 may include inner feedback loop, first catalyst 71, and the HEGO sensor placed after the first catalyst. Procedures for control parameter calibration are presented in FIG. 3.

FIG. 3 shows an example method 300 of catalyst control via a feedback loop, such as the outer feedback loop shown in FIG. 2. Control parameters of outer loop controller may be determined by checking lookup table. Under certain engine operating conditions, the lookup table may be updated by driving the outer feedback loop to a point of feedback control instability.

Instructions for carrying out method 300 and the rest of the methods included herein may be executed by a vehicle controller (such as controller 12 in FIG. 1) based on instructions stored on a memory of the controller and in conjunction with signals received from sensors of the engine system, such as the sensors described above with reference to FIG. 1. The vehicle controller may employ engine actuators of the engine system to adjust engine operation, according to the methods described below.

At step 301, vehicle operating conditions are determined by the vehicle controller. The controller acquires measurements from various sensors in the engine system and estimates operating conditions including engine load, engine speed, mass flow upstream of the first catalyst, vehicle torque demand, catalyst temperature, and throttle position.

At step 302, method 300 loads a lookup table for determining control parameters of the outer loop feedback controller. In an embodiment, the lookup table may include a pre-determined (a base lookup table) stored in the non-transitory memory of the vehicle controller. The base lookup table may contain a calibration representative of a certified emissions development vehicle equipped with a moderately aged catalyst. The base lookup table may be suitable for a range of different aged catalysts, but not necessarily optimal for very new or old catalysts. As an example, the base lookup table may store mass flow rates upstream of the first catalyst and corresponding control parameters. In another embodiment, the base lookup table may include mass flow rates and corresponding system characteristics of a modeled plant (such as plant 200 in FIG. 2), such as system delay and system gain. During engine operation, control parameters of the outer loop controller may be calculated online as a mathematical function of the system characteristics. In yet another example, the lookup table may further include a correction table saving the difference between the updated and base control parameters or system parameters.

At step 303, method 300 determines if the vehicle is in a condition that allows for an on-line update of control parameters. The acceptable conditions for on-line update may include one or more of 1) steady engine operation and sufficiently activated first catalyst (71); 2) the vehicle drivetrain is under conditions that may mask any noise vibration harshness (NVH) potentially induced by the on-line characterization mode; 3) sufficient second catalyst (70) activity to absorb emissions that breakthrough the first catalyst (72) during on-line calibration; and 4) sufficient time/drive cycles between control parameter updates to avoid excessive on-line testing. The first acceptable condition of steady engine operation may be determined responsive to steady mass flow upstream of the first catalyst. As an example, the mass flow may be measured by a sensor (such as sensor 72 in FIG. 1). As another example, the mass flow may be estimated based on mass air flow entering cylinder through the throttle. The Steady mass flow may also be established by estimating mass flow based on one or more of engine speed staying within a set of limits, temporary suspension of any canister purge operation, catalyst temperature models, and HEGO activity that indicate first catalyst (71) activation. In the second acceptable condition, noise vibration harshness (NVH) level may be determined by either engine load/speed and transmission gear choices known to mask vehicle NVH or checking on-board accelerometers. In the third acceptable condition, an estimate that the second catalyst (70) is sufficiently active may be determined by the temperature of the second catalyst or recent duration at that temperature. In the fourth acceptable condition, the number of updates should be limited based on a minimum duration of time or separate drive cycles and/or some other indication that the lookup table values may have been altered. In other words, duration between contiguous lookup table updates should not be less than a threshold. This is because on-line updates of the parameters may be intrusive to some operations such as canister purge and other system diagnostics. If the system is prepared to accept the on-line characterization mode of operation, method 300 moves to step 304. Otherwise, method 300 moves to step 305.

At step 304, method 300 determines whether the current lookup table needs to be updated. As one example, the lookup table may be updated after a pre-determined time duration. The pre-determined time duration relates to a duration of possible catalyst degradation. As another example, a catalyst aging model, determined in the development for a moderately aged catalyst, may be checked against current catalyst response and signal an opportunity for a correction update. If it is determined to update the lookup table, method 300 moves to step 306, wherein control parameters are recalibrated at current mass flow rate. Otherwise, method 300 moves to step 305, wherein the outer loop controller is used for catalyst control.

At step 306, method 300 determines an AFR set point and a corresponding AFR step size. In an embodiment, the AFR set point may be stoichiometry. In another embodiment, the AFR set point may be slightly offset from stoichiometry so as to match the typical emission calibration which seeks to provide the best tradeoff of emission reduction among various regulated constituents. For example, the AFR set point may be slightly rich, such as 0.9985. The AFR step size may be selected as a small fraction of the AFR set point. For example, AFR step size may be 1-3% of the AFR set point. In one embodiment, a rich AFR step size and a lean AFR step size may be selected. As one example, the rich AFR step size may be the same as the lean AFR step size. As another example, the rich AFR step size may be different from the lean AFR step size. Step 306 further connects the input of inner loop controller to a relay function, so that the outer loop controller is bypassed.

At step 307, reference AFR (such as ref_AFR in FIG. 2) is set to be the AFR set point determined from step 306. In an embodiment, the reference AFR is set to be the AFR set point for all engine banks with separate catalyst paths.

At step 308, actual AFR downstream of the first catalyst is measured with an oxygen sensor, such as sensor 76 in FIG. 1. In an example, the actual AFR may be measured with a HEGO sensor. The actual AFR may alternatively be measured with an UEGO sensor.

At step 309, method 300 may calculate an error by subtracting the measured AFR from the reference AFR. If the error is positive, method 300 determines whether to terminate control parameter calibration at step 310. The calibration may be terminated by switching input of the inner loop controller from the relay function to the outer loop controller. As an example, method 300 may terminate calibration when sufficient relay cycles of the measured AFR have been collected. As another example, method 300 may terminate calibration after a predetermined time period. As yet another example, method 300 may terminate when the vehicle conditions are no longer acceptable to operate in the relay mode and the update will have to wait for another opportunity to run, but some of the data can be preserved until a further update is possible. At step 313, the reference AFR may be stepped lean by a lean AFR step size determined in step 306.

If the error is negative, method 300 moves to step 311 to determine whether terminating the calibration process. Similar to step 310, the calibration may be terminated when sufficient relay cycles of the measured AFR have been collected. Alternatively, the calibration process may be terminated after a time period. Then, the reference AFR may stepped rich by a rich AFR step size determined in step 306. By stepping rich or lean based on the sign of the error, the measured AFR downstream of the first catalyst will respond after a delay. Successive relay switches may result in AFR downstream of the first catalyst converging to an oscillation with a near steady period and amplitude relative to the AFR set point.

At step 314, characteristics of plant 200, such as system gain system and delay, may be determined based on amplitude and period of the oscillation. As an example, the system gain and delay may be determined based on an average of several cycles of the oscillation, since there may be slight variation between relay cycles. Once a representative period and amplitude of the oscillation are determined for a mass flow condition, the calculated control parameters can be produced. As an example, the difference between the current estimate and the base lookup table may be logged in a separate correction table. The controller may use the sum of the base and correction table as control parameters. As another example, aside from a base lookup table saving control parameters of a nominal system, the updated control parameters are saved in a separated lookup table, which may be directly accessed by the controller. In one embodiment, limits may be enforced to the correction table or the updated lookup table to constrain the difference between the new control parameters from the ones in the base lookup table. The difference higher than a threshold may be used by diagnostic systems to detect potential failure modes. As one example, parameters in the correction table exceeding a predetermined upper and lower limit may be set to the limits.

FIG. 4B shows a relay function output 451 and idealized measured AFR 452 downstream of the first catalyst. The x-axes indicate time, and increase from left to right. At $T_1$, in response to negative error between AFR set point 420 and measured AFR, relay function output steps rich with a step size of $S_{rich}$. Consequently, the measured AFR first moves apart from, then close to set point AFR 420. At $T_2$, in response to the error changes from negative to positive, relay function output steps lean with a step size of $S_{lean}$. As such, measured AFR oscillates about the set point AFR. Relay output is in the form of square wave, also oscillates about set point AFR. Each crossing of the measured AFR 452 with set point AFR 420 may be monitored. Time duration between every other crossing may be measured as the period of the oscillation $T_{period}$. Positive peak $y_{max}$ and negative peak $y_{min}$ may be tracked. They difference between the positive peak and negative peak may be calculated as the amplitude of the oscillation. System delay $\tau_d$ and system gain k may then be calculated based on the period and the amplitude according to Equations 1-2:

$$\tau_d = \frac{T_{period}}{4} \quad \text{Equation 1}$$

$$k = \frac{y_{max} - y_{min}}{2\tau_d(S_{rich} + S_{lean})} \quad \text{Equation 2}$$

Method 300 may calculate control parameters based on the system delay and system gain. Details on the structure of the outer loop controller and the calculation of its control parameters are presented in FIG. 6.

Turning back to FIG. 3, method 300 may updates the correction table that will correct the base lookup table at step 314. The base table's values are preserved to keep track of a known moderately aged catalyst values for use in comparison to the current state. As one example, the gain and delay stored in the lookup table corresponding to current mass flow may be updated.

At step 315, method 300 terminates the calibration by connecting output of the outer loop controller with the input of the inner control loop, and the catalyst is controlled via the updated lookup table.

In an embodiment, the base lookup table may be constructed off-line by driving the system to a point of feedback control instability at various exhaust mass flow. In other words, control parameters or system characteristics may be determined by performing system identification at a list of predetermined mass flow rates. The calibrated look-up table may be then saved in the non-transitory memory of the controller. The base lookup table, having been determined under laboratory conditions, can represent all allowed mass flows, some of which may not be accessible in an on-line operation. Further, systems that do not have a second catalyst due to cost/packaging limitations, may not be able to rely on on-line updates.

FIG. 4A illustrates the variation of torque demand 401, relay output 402, measured AFR downstream of the first catalyst 403, and temperature of the second catalyst 404 over time.

From $T_1$ to $T_2$, the catalyst is controlled via outer loop controller, and control parameters may be determined from a loaded lookup table. Mass flow 401 remains between thresholds 410 and 411. Since the variation of the mass flow is within a threshold Th for a duration from $T_1$ to $T_2$, engine controller (such as engine controller 12 in FIG. 1) may determine that the engine is under steady engine operation. Similar checks can be done for the other conditions (such as conditions in step 303 of FIG. 3) required for an update. Temperature of the second catalyst is lower than threshold 430.

At time $T_2$, in response to engine steady operation and temperature of the second catalyst higher than threshold 430, controller determines to tune the control parameters, and start to drive the catalyst via a relay function instead of the outer loop controller. Relay function outputs a square wave oscillating about a set point AFR 420. Consequently, AFR downstream of the first catalyst oscillates about the set point AFR 420.

By time $T_3$, the controller completes calibrating control parameters based on the oscillation of measured AFR 403 and relay output 402. The catalyst is controlled using the updated control parameters.

Control parameters may be determined based on the system delay and system gain based on internal model control (IMC). FIG. 5 shows an example internal model control structure. P(s) is the transfer function of plant 200. P(s) may have the following gain integration form based on system delay τ and system gain k:

$$P(s) = k\frac{e^{-\tau s}}{s}. \qquad \text{Equation 3}$$

By selecting Q(s) to be an approximate inverse of the process model without the time delay:

$$Q(s) = \frac{s}{k}\frac{(\beta s+1)}{(\alpha s+1)^2}, \qquad \text{Equation 4}$$

yields the following final IMC controller:

$$C(s) = \frac{1}{k}\frac{(\beta s+1)\left(\frac{\tau_d}{2}s+1\right)}{s\left(\frac{\alpha^2\tau_d}{2}s+\alpha^2+2\alpha\tau_d+\frac{\tau_d^2}{2}\right)}, \qquad \text{Equation 5}$$

wherein $$\alpha = bw_mult \times \tau, \beta = 2+\alpha. \qquad \text{Equation 6}$$

The parameter bw_mult allows the overall controller to be made more or less aggressive. In an example, bw_mult may be between 2 to 5. Increased β may soften the signal, whereas decreased β may result in a more forceful change in the system output. Other control parameters including recip_eta and halfsqalpha may be calculated based on Equations 7-8:

$$recip_{eta} = 2\tau_d\alpha + \frac{\tau_d^2}{2} + \alpha^2, \qquad \text{Equation 7}$$

$$halfsqalpha = \frac{\tau_d\alpha^2}{2\times \text{recip_eta}}. \qquad \text{Equation 8}$$

FIG. 6 is a block diagram showing the structure of the outer loop controller derived through IMC. A detailed time-domain realization of the outer loop controller is shown in FIG. 7, wherein blocks serving the same function as FIG. 6 are numbered the same.

Input signal ref_AFR is first filtered through a lag-lead filter 601 before comparing to the measured AFR. As an example, lag-lead filter 601 may have a transfer function of $$R(s) = \frac{\alpha s+1}{\beta s+1},$$

wherein filter parameters α and β are calculated according to Equation 6. By filtering the desired signal ref_AFR based on the system characterization, dynamics of the input may be damped. The purpose of this filter is to slow down reference commands that are so fast that the feedback control cannot adequately control (may suffer from overshoot) due to the pure delay that plant has at any particular operating point.

The filtered AFR sp_filt is compared with AFR2 downstream of the first catalyst. The sensor, such as a HEGO sensor, outputs a voltage signal AFR2 responsive to the AFR. In order to be compared with sp_filter, sensor output AFR2 may be processed with a HEGO inverse function 609 to get measured_afr. The HEGO transfer function converts the voltage signal to corresponding AFR signal. The error err between sp_filt and measured_afr is calculated and sent to a lead-lag filter 602 and gain schedule error block 604. The lead-lag filter 602 provides the controller a limited amount of anticipatory action. Block 602 has a transfer function of $$\frac{\beta s + 1}{\alpha^2 \frac{\tau 1}{2\eta} s + 1}.$$

The anticipation filter 602 includes a feedthrough branch using β as a gain to make the signal more forceful when a change in the error occurs. The lead-lag filter 602 also includes a recursive branch in lead-lag filter block 602 using alpha and delay gain to moderate the effect of feed through branch. Due in part to the voltage to AFR conversion through the HEGO transfer function and in part to the overall systems non-linearity, the error may be nonlinear. Gain schedule error block 604 weights positive and negative error differently to make the error signal more linear if necessary. The output of block 602 is further adjusted with the system gain via block 603 (derived in Equation 5). Outputs of block 603 and 604 are combined and referred to as gain_err, which reflects signal conditioning applied to the base error (err).

The gain_err is adjusted by an iteration term that guards against windup if the clips of the controller output are reached. As long as the controller does not reach saturation, the adjustment to the gain_err is zero. The adjusted gain_err is sent to PI controller 605. The PI controller may have a transfer function of $$\frac{\frac{\tau_d}{2} s + 1}{s}.$$

In the time domain, the adjusted gain_err signal may be processed with two branches: a simple control term that reacts directly to the error signal based on system delay, and an accumulating branch that can counter persistent errors. The PI controller outputs a signal to a clip block 606 and generates a pi_out signal. The clip block limits the PI controller output bytr setting limits pi_mn and pi_mx. The clip block makes sure that the control term's internal states do not continue to increase if the control output is clipped. Signal before and after the clip block are sent to the anti-windup block 607.

The pi_out signal is send to plant 200 to make fueling decisions. For example, the controller may adjust a FPW signal as a mathematical function of the pi_out signal and send it to the driver of fuel injectors. After engine operation in plant 200, exhaust gases pass through the first catalyst. Oxygen sensor measures the AFR and outputs AFR2.

In this way, control parameters for the outer control loop directly correspond to characterized model parameters which can be captured with precision in an offline laboratory test and may be updated online to accommodate possible catalyst degradation. The technical effect of calibrating the control parameters at various exhaust mass flow rates is that the feedback control has the highest level of responsiveness without becoming unstable even though the system's dynamics change significantly with mass flow. While a base table of control parameters alone may be adequate (bw_mult, from Equation 6, may have to be set to a relatively conservative choice), an online update to the control parameters may adjust the controller specifically for a vehicle, eliminating the effect of part-to-part variability and/or aging and providing more robust feedback control. The technical effect of controlling the AFR downstream of the catalyst is that the catalyst may be maintained at high working efficiency even in the presence of upstream disturbances. Technical effect of updating the control parameters online is that the control parameters may be updated in response to system degradation, such as catalyst degradation. Technical effect of control the inner loop through a relay function is that system identification may be performed by inducing an oscillation in the AFR downstream of the catalyst. By driving the feedback control to a point of instability during steady engine operation, the mass flow during control parameter calibration may be kept constant, with minimal impact on engine operation.

As one embodiment, a method for an engine system, comprising: during steady engine operation, adjusting fuel injection to a cylinder responsive to sensor feedback from downstream of a catalyst volume based on control parameters, the control parameters determined based on system identification at a point of feedback control instability. In a first example of the method, wherein system identification includes identifying system delay and system gain. A second example of the method optionally includes the first example and further includes, adjusting the fuel injection based on an air-fuel ratio upstream of the catalyst volume. A third example of the method optionally includes one or more of the first and second examples, and further includes, determining the control parameters based on a mass flow upstream of the catalyst volume. A fourth example of the method optionally includes one or more of the first through third examples, and further includes, determining the control parameters when the temperature of a second catalyst volume downstream of the catalyst volume is higher than a threshold. A fifth example of the method optionally includes one or more of the first through fourth examples, and further includes, adjusting the fuel injection based on difference between a filtered reference air-fuel ratio and the sensor feedback, wherein the reference air-fuel ratio is filtered based on the control parameters. A sixth example of the method optionally includes one or more of the first through fourth examples, and further includes, adjusting the fuel injection when variation in engine torque demand is lower than a threshold for a time period.

As another embodiment, a method for an engine, comprising: determining a fuel injection amount responsive to an air-fuel ratio downstream of a catalyst via a feedback controller, wherein parameters of the feedback controller is determined via a lookup table based on an exhaust mass flow; and during steady engine operation, updating the lookup table based on system identification at a point of feedback control instability. In a first example of the method, the method further comprises generating the lookup table off-line by driving the system to a point of feedback control instability at each exhaust mass flow to the cylinder. A second example of the method optionally includes the first example and further includes determining feedback controller parameters based on inverse of the system identification. A third example of the method optionally includes one or more of the first and second examples, and further includes determining a system delay and a system gain during system identification. A fourth example of the method optionally includes one or more of the first through third examples, and further includes, wherein a gain of the feedback controller is increased with decreased system gain. A fifth example of the method optionally includes one or more of the first through fourth examples, and further includes, wherein a gain of the feedback controller is increased with decreased system delay. A sixth example of the method optionally includes one or more of the first through fifth examples, and further includes, adjusting the fuel injection via an inner feedback loop based on an air-fuel ratio upstream of the catalyst. A seventh example of the method optionally includes one or more of the first through sixth examples, and further includes, driving the system to a point of feedback control instability by controlling the inner feedback loop via a relay function, bypassing the feedback controller.

As yet another embodiment, an engine system, comprising: a cylinder; fuel injectors for injecting fuel to the cylinder; a first catalyst; a second catalyst coupled downstream of the first catalyst; a first sensor for sensing a first air-fuel ratio upstream of the first catalyst; a second sensor for sensing a second air-fuel ratio between the first and the second catalyst; and an engine controller configured with computer readable instructions stored on non-transitory memory for: adjusting fuel injection amount based on feedback from a first sensor through an inner feedback control loop; adjusting fuel injection amount based on feedback from a second sensor through an outer feedback control loop; and during steady engine operation, updating control parameters of the outer feedback control loop through system identification at a point of feedback control instability. In a first example of the system, the engine controller is further configured for determining control parameters of the outer feedback control loop via a lookup table. A second example of the system optionally includes the first example and further includes, wherein an oscillation in the air-fuel ratio downstream is induced at the point of feedback control instability. A third example of the system optionally includes one or more of the first and second examples, and further includes, wherein the engine controller is further configured for determining system gain and system delay based on amplitude and period of the oscillation. A fourth example of the system optionally includes one or more of the first through third examples, and further includes, wherein the first sensor is a UEGO sensor, and the second sensor is a HEGO sensor.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine system, comprising:

during steady engine operation, adjusting fuel injection to a cylinder responsive to sensor feedback from downstream of a catalyst volume based on control parameters, the control parameters determined based on system identification at a point of feedback control instability; and adjusting the fuel injection when variation in engine torque demand is lower than a threshold for a time period.

2. The method of claim 1, wherein system identification includes identifying system delay and system gain.

3. The method of claim 1, further comprising adjusting the fuel injection based on an air-fuel ratio upstream of the catalyst volume.

4. The method of claim 1, further comprising determining the control parameters based on a mass flow upstream of the catalyst volume.

5. The method of claim 1, further comprising determining the control parameters when a temperature of a second catalyst volume downstream of the catalyst volume is higher than a threshold.

6. The method of claim 1, further comprising adjusting the fuel injection based on a difference between a filtered reference air-fuel ratio and the sensor feedback, wherein the reference air-fuel ratio is filtered based on the control parameters.

7. A method for an engine system, comprising:

determining a fuel injection amount responsive to an air-fuel ratio downstream of a catalyst via a feedback controller, wherein parameters of the feedback controller are determined via a lookup table based on an exhaust mass flow; and during steady engine operation, updating the lookup table based on system identification at a point of feedback control instability.

8. The method of claim 7, further comprising generating the lookup table off-line by driving the system to the point of feedback control instability at each exhaust mass flow.

9. The method of claim 7, further comprising determining the feedback controller parameters based on an inverse of the system identification.

10. The method of claim 9, further comprising determining a system delay and a system gain during the system identification.

11. The method of claim 10, wherein a gain of the feedback controller is increased with decreased system gain.

12. The method of claim 10, wherein a gain of the feedback controller is increased with decreased system delay.

13. The method of claim 7, further comprising adjusting fuel injection via an inner feedback loop based on an air-fuel ratio upstream of the catalyst.

14. The method of claim 13, further comprising driving the system to the point of feedback control instability by controlling the inner feedback loop via a relay function, bypassing the feedback controller.

15. An engine system, comprising:

a cylinder;

fuel injectors for injecting fuel to the cylinder;

a first catalyst;

a second catalyst coupled downstream of the first catalyst;

a first sensor for sensing a first air-fuel ratio upstream of the first catalyst;

a second sensor for sensing a second air-fuel ratio between the first and second catalysts; and an engine controller configured with computer readable instructions stored in non-transitory memory for:

adjusting a fuel injection amount based on feedback from the first sensor through an inner feedback control loop;

adjusting the fuel injection amount based on feedback from the second sensor through an outer feedback control loop; and during steady engine operation, updating control parameters of the outer feedback control loop through system identification at a point of feedback control instability.

16. The system of claim 15, wherein the engine controller is further configured for determining the control parameters of the outer feedback control loop via a lookup table.

17. The system of claim 15, wherein an oscillation in an air-fuel ratio downstream is induced at the point of feedback control instability.

18. The system of claim 17, wherein the engine controller is further configured for determining system gain and system delay based on amplitude and a period of the oscillation.

19. The system of claim 15, wherein the first sensor is a UEGO sensor, and the second sensor is a HEGO sensor.

* * * * *